US007463747B2

(12) United States Patent
Kuze et al.

(10) Patent No.: US 7,463,747 B2
(45) Date of Patent: Dec. 9, 2008

(54) LOUDSPEAKER SYSTEM

(75) Inventors: Mitsukazu Kuze, Osaka (JP); Shuji Saiki, Nara (JP); Sawako Kano, Hyogo (JP); Toshiyuki Matsumura, Osaka (JP)

(73) Assignee: Panasonic Corporation, Osaka (JP)

( * ) Notice: Subject to any disclaimer, the term of this patent is extended or adjusted under 35 U.S.C. 154(b) by 317 days.

(21) Appl. No.: 10/594,504

(22) PCT Filed: Mar. 24, 2005

(86) PCT No.: PCT/JP2005/005342

§ 371 (c)(1),
(2), (4) Date: Sep. 28, 2006

(87) PCT Pub. No.: WO2005/099300

PCT Pub. Date: Oct. 20, 2005

(65) Prior Publication Data

US 2007/0147645 A1 Jun. 28, 2007

(30) Foreign Application Priority Data

Mar. 31, 2004 (JP) ..... 2004-103759

(51) Int. Cl.
*H04R 25/00* (2006.01)

(52) U.S. Cl. ..... 381/345; 381/349; 381/189

(58) Field of Classification Search ..... 381/87, 381/89, 334, 337, 345, 346, 349, 353, 354, 381/386, 391, 189; 181/146, 148, 149, 151, 181/156, 160, 199

See application file for complete search history.

(56) References Cited

U.S. PATENT DOCUMENTS

| | | | | | |
|---|---|---|---|---|---|
| 3,987,258 | A | * | 10/1976 | Tsutsui et al. | 381/334 |
| 4,657,108 | A | | 4/1987 | Ward | |
| 4,953,655 | A | * | 9/1990 | Furukawa | 181/160 |
| 5,073,937 | A | * | 12/1991 | Almasy | 381/386 |

FOREIGN PATENT DOCUMENTS

| | | |
|---|---|---|
| JP | 59-63182 | 5/1981 |
| JP | 57-72680 | 5/1982 |
| JP | 60-500645 | 5/1985 |
| JP | 61-75693 | 5/1986 |
| JP | 63-33288 | 3/1988 |
| JP | 01-226296 | 9/1989 |
| JP | 4-57215 | 5/1992 |
| JP | 2000-41293 | 2/2000 |
| JP | 2002-209288 | 7/2002 |
| WO | 03/013183 | 2/2003 |

* cited by examiner

*Primary Examiner*—Huyen D Le
(74) *Attorney, Agent, or Firm*—Wenderoth, Lind & Ponack, L.L.P.

(57) ABSTRACT

A loudspeaker unit (2) of a loudspeaker system (1) is fitted to a cabinet (4). An absorbent (3) is disposed in a hollow chamber (R) inside the cabinet (4) and absorbs a gas inside the hollow chamber (R). A phase inverting mechanism (8) inverts the phase by resonating with a sound of a specific frequency radiated from the loudspeaker unit (2) into the hollow chamber (R) and radiates this sound to outside. The watertight means of the phase inverting mechanism (8) prevents invasion of moisture into inside the hollow chamber (R) from outside the cabinet (4) through the phase inverting mechanism (8).

8 Claims, 11 Drawing Sheets

LOUDSPEAKER SYSTEM

TECHNICAL FIELD

The present invention relates to a loudspeaker system, and more particularly, to a loudspeaker system which reproduces a low frequency sound with a compact-size speaker cabinet.

BACKGROUND ART

Due to the influence of the acoustic stiffness inherent to a hollow chamber of a speaker cabinet, it is generally difficult to realize a speaker system which is capable of reproducing a low frequency sound using a compact-size loudspeaker system. In an attempt to realize reproduction of a low frequency sound with a compact-size loudspeaker system, an airtight loudspeaker system whose cabinet houses a lump of activated carbon inside is known as means which solves the problem that the capacity of a cabinet sets a limit upon reproduction of a low frequency sound. (See Patent Document 1 for instance.)

FIG. 10 is a cross sectional view which shows the structure of an essential part of the loudspeaker system described in Patent Document 1 mentioned above. In FIG. 10, the loudspeaker system comprises a cabinet 101, a low frequency sound speaker 102, activated carbon 103, a support member 104, a diaphragm 105 and a vent pipe 106. The low frequency sound speaker 102 is fitted to the front surface of the cabinet 101. The activated carbon 103 is disposed as a lump inside the cabinet 101 and supported by the back surface, the bottom surface, the top surface, the side surfaces of the right-hand side and the left-hand side of the cabinet 101 and by the support member 104. All over the surface of the support member 104, there are fine pores which permit air ventilation. The vent pipe 106 is disposed to the diaphragm 105 and ventilates between the activated carbon 103 and the low frequency sound speaker 102.

An operation of the loudspeaker system above will now be described. Application of an electric signal upon the low frequency sound speaker 102 changes the pressure inside the cabinet 101, and this pressure vibrates the diaphragm 105. As the diaphragm 105 vibrates, the pressure inside the hollow chamber in which the activated carbon 103 is disposed changes. While the support member 104 and the cabinet 101 support the activated carbon 103 as a lump, due to the fine pores formed all over the surface of the support member 104, the change of the pressure attributable to the vibrations of the diaphragm 105 causes absorption of air molecules by the activated carbon 103, whereby a variation of the pressure inside the cabinet 101 is suppressed.

In the conventional loudspeaker system, the cabinet 101 thus operates equivalently as a large-capacity cabinet, i.e., although being a compact-size cabinet, reproduces a low frequency sound as if a loudspeaker unit were mounted to a large cabinet. Meanwhile, the vent pipe 106, owing to the temperature around the loudspeaker system and a pressure change inside the loudspeaker system, prevents a pressure variation within the space which houses the activated carbon 103 and is surrounded by the diaphragm 105 and the cabinet 101.

In the meantime, a bass reflex-type speaker cabinet is generally used as a system which enhances a low frequency sound better than an airtight cabinet does. FIG. 11 is a cross sectional view which shows the structure of a bass reflex-type loudspeaker system. In FIG. 11, the illustrated loudspeaker system comprises a cabinet 111, a loudspeaker unit 112 and an acoustic port 113. The loudspeaker unit 112 is fitted to the front surface of the cabinet 111. The acoustic port 113 is disposed to the front surface of the cabinet 111 so that via the acoustic port 113, a hollow chamber R defined by the cabinet 111 is opened to outside. Utilizing the acoustic capacity of the cabinet 111 and acoustic resonance due to the acoustic port 113 disposed to the cabinet 111, the loudspeaker system radiates a low frequency sound.

[Patent Document 1] Published Patent Application No. 60-500645

DISCLOSURE OF THE INVENTION

Problems to be Solved by the Invention

A combination of the activated carbon's effect of absorbing air molecules with a bass reflex-type loudspeaker system is considered to realize a loudspeaker system which is compact yet capable of effectively reproducing a low frequency sound. However, the hollow chamber R shown in FIG. 11 is opened to outside, allowing invasion of moisture contained in the outside air into inside the cabinet 111 via the acoustic port 113. The activated carbon 103, due to its excellent hydrophilic property, absorbs the incoming water molecules and becomes incapable of absorbing air molecules at the time of a pressure change caused by vibrations of the diaphragm 105 (FIG. 10). This destroys the effect of the activated carbon 103 that the cabinet has an equivalent large capacity and makes it difficult to realize reproduction of a low frequency sound which the loudspeaker system aims at.

Accordingly, an object of the present invention is to provide a loudspeaker system whose cabinet houses inside an absorbent (activated carbon) which physically absorbs a gas and which improves its capability of reproducing a low frequency sound while maintaining the physical absorption capability of the absorbent.

Solution to the Problems

To achieve the above objects, the present invention has the following aspects.

A first aspect of the present invention is directed to a loudspeaker system which comprises a cabinet, a loudspeaker unit, an absorbent and a phase inverting mechanism. The loudspeaker unit is fitted to the cabinet. The absorbent is located inside a hollow chamber of the cabinet and physically absorbs a gas which is present in the hollow chamber. The phase inverting mechanism inverts the phase by resonating with a sound of a specific frequency radiated from the loudspeaker unit into the hollow chamber, and radiates this sound to outside. The phase inverting mechanism is equipped with watertight means. The watertight means prevents moisture from invading from the outside of the cabinet into the hollow chamber through the phase inverting mechanism.

In a second aspect of the present invention, the phase inverting mechanism according to the first aspect is a drone cone which is disposed in an opening formed in the cabinet. The watertight means is a drone cone which blocks ventilation between the outside of the cabinet and the hollow chamber.

In a third aspect of the present invention, the drone cone according to the second aspect is coated with at least wax or a resin material.

In a fourth aspect of the present invention, the phase inverting mechanism according to the first aspect is an acoustic port which is disposed in an opening formed in the cabinet. The watertight means is a damp proofing agent which is disposed stationary inside the acoustic port.

In a fifth aspect of the present invention, the absorbent according to the first aspect is activated carbon.

A sixth aspect of the present invention is directed to a portable information processing device which comprises the loudspeaker system according to the first aspect described above and a housing in which this loudspeaker system is fixed.

A seventh aspect of the present invention is directed to an audio visual system which comprises the loudspeaker system according to the first aspect described above and a housing in which this loudspeaker system is fixed.

An eighth aspect of the present invention is directed to a vehicle which comprises the loudspeaker system according to the first aspect described above and a vehicle body which fixes this loudspeaker system inside the vehicle.

Effect of the Invention

The first aspect described above realizes a phase inverting-type cabinet which has an apparent large capacity due to the absorbent's physical absorption effect, and hence, reproduction of a low frequency sound even at a lower frequency than a limitation of low frequency sound reproduction which is determined generally by the size of a cabinet. Further, the watertight means prevents moisture contained in the outside air from invading into the cabinet through the phase inverting mechanism. As the absorbent absorbs moisture contained in the outside air, the function of physically absorbing a gas inside the cabinet will not be impaired. Hence, the absorbent's physical absorption capability will not be degraded and the effect that the apparent acoustic capacity grows will not be impaired.

The second aspect described above, realizing a phase inversion-mode using a drone cone which has a low air permeability, makes it easy to prevent moisture contained in the outside air from invading into the cabinet. Meanwhile, in the case of a loudspeaker system of the passive radiator type, the sound pressure inside the cabinet is higher than in a bass reflex-type device, and therefore, achieves an excellent capacity expansion effect owing to the absorbent's physical absorption effect and attains an equivalent resonance-induced bass expansion effect to that of the bass reflex type. This is expected to create a better bass expansion effect than an effect which is predicted to be achieved by a simple combination of the physical absorption effect and the phase inversing mode, and hence, realizes a better bass reproduction capability than a combination of the resonance-induced effect and the physical absorption effect.

The third aspect described above, requiring coating of a vibration plate, a suspension and the like forming a drone cone with wax, a resin material or the like, further improves the watertight function of preventing moisture contained in the outside air from invading into the hollow chamber.

The fourth aspect described above, realizing the phase inversing mode by disposing the damp proofing agent stationary inside the acoustic port, easily prevents invasion of moisture contained in the outside air into the cabinet through the acoustic port. Further, the damp proofing agent in the form of granules or powder, when covered by a perforated bag or a mesh-like member and disposed stationary inside the acoustic port, serves as an acoustic resistance in the acoustic port. As the damp proofing agent damps a low frequency sound radiated from the acoustic port, the loudspeaker system reproduces a more flat bass characteristic. Further, although the sound pressure inside the cabinet of a bass reflex-type loudspeaker system is lower than in a device of the airtight type or the passive radiator type and it is therefore harder to enjoy the physical absorption effect of the absorbent which is disposed inside the cabinet, the damp proofing agent disposed inside the acoustic port makes it possible to suppress a decrease of the sound pressure inside the cabinet. This maintains the absorbent's physical absorption effect, and the effect of obtaining an excellent bass reproduction capability is also expected.

The fifth aspect described above, requiring that the absorbent is made of activated carbon, equivalently increases the capacity of the cabinet and realizes reproduction of a low frequency sound with a compact-size cabinet.

The portable information processing device, the audio visual system and the vehicle according to the present invention, mounting the loudspeaker system described above, achieve similar effects.

DESCRIPTION OF THE REFERENCE CHARACTERS

Figure 1:
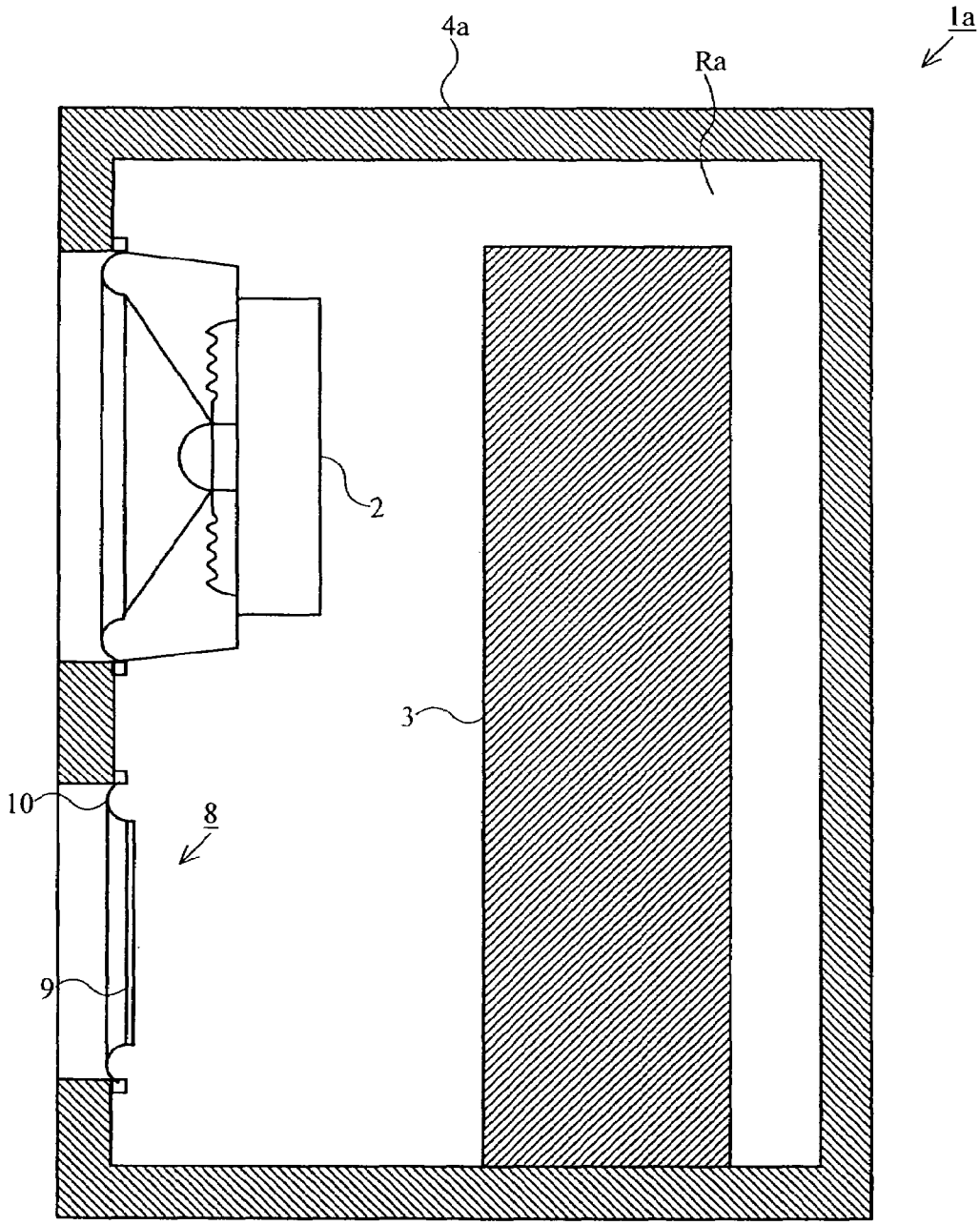
FIG. 1 is a cross sectional view which schematically shows the internal structure of a loudspeaker system 1*a* according to a first embodiment of the present invention.

1 loudspeaker system
2 loudspeaker unit
3 absorbent
4 cabinet
7 acoustic port
8 drone cone
9 vibration plate
10 suspension
11 damp proofing agent

BEST MODE FOR CARRYING OUT THE INVENTION

First Embodiment

With reference to FIG. 1, the loudspeaker system according to the first embodiment of the present invention will now be described. The loudspeaker system according to the first embodiment uses a passive radiator (drone cone) system as one example of the phase inversion mode. FIG. 1 is a cross sectional view which schematically shows the internal structure of the loudspeaker system 1*a*.

In FIG. 1, the loudspeaker system 1*a* comprises a loudspeaker unit 2, an absorbent 3, a cabinet 4*a* and a drone cone 8. The cabinet 4*a* forms the front surface, the back surface, the top surface, the bottom surface and the side surfaces of the right-hand side and the left-hand side of a housing of the loudspeaker system 1*a*. The loudspeaker unit 2 is an electrodynamic speaker and fitted to an opening of the front surface of the cabinet 4*a*. Inside the cabinet 4*a*, a hollow chamber Ra of the loudspeaker system 1*a* is created.

The absorbent 3 is disposed inside the hollow chamber Ra. The absorbent 3 is a porous material which physically absorbs a gas and may for example be activated carbon. A porous material is capable of physically absorbing air through fine pores whose sizes are on the order of microns. As other examples, the absorbent 3 may be zeolite, silica ($SiO_2$), alumina ($Al_2O_3$), zirconia ($ZrO_3$), magnesia (MgO), triiron tetroxide ($Fe_3O_4$), a molecular sieve, fullerene or a carbon nano tube. Created above the top of the absorbent 3 or at otherwise appropriate location is an empty space which ventilates the loudspeaker system 1*a* along the front-rear direction.

The drone cone 8 comprises a vibration plate 9 and a suspension 10 and is fitted to the opening of the front surface of the cabinet 4*a*. The suspension 10 is fixed in the opening of the front surface of the cabinet 4*a* and supports the vibration plate 9. Chosen as the vibration plate 9 and the suspension 10 are those which exhibit a low air permeability like those which are used for an ordinary speaker, which prevents outside air or moisture contained in the outside air from moving through the drone cone 8 and invading into the hollow chamber Ra. The vibration plate 9 may be made of a resin material such as polypropylene and the suspension 10 may be made of synthetic rubber or the like for instance, which prevents the outside air or moisture contained in the outside air from invading into the hollow chamber Ra. Other example is coating of the vibration plate 9 and the suspension 10 with wax, a resin material or the like, which prevents the outside air or moisture contained in the outside air from invading into the hollow chamber Ra. The hollow chamber Ra created inside the cabinet 4*a* thus serves as an airtight space which is blocked from the outside air and moisture contained in the outside air. The drone cone 8 thus provides water tightness between the external space and the hollow chamber Ra, and this structure of the drone cone 8 and the treatment on the drone cone 8 correspond to the watertight means of the present invention.

An operation of the loudspeaker system 1*a* will now be described. While an operation of the loudspeaker unit 2 which is an electrodynamic speaker is known and will not therefore be described in detail, application of a music signal upon the loudspeaker unit 2 develops force at a voice coil, whereby the cone-shaped vibration plate vibrates and a sound is created. The loudspeaker unit 2 radiates the sound also to the hollow chamber Ra which is inside the cabinet 4*a*. A resonator is thus formed by the internal capacity of the cabinet 4*a* (the capacity of the hollow chamber Ra), the stiffness of the suspension 10 of the drone cone 8 and the mass of the vibration plate 9 of the drone cone 8. At the resonance frequency of the resonator, a sound radiated into inside the cabinet 4*a* maximizes the amplitude of the drone cone 8, whereby the vibration plate 9 of the drone cone 8 radiates a larger sound. Since the sound radiated by the drone cone 8 is in the same phase as that of the sound radiated by the loudspeaker unit 2, this resonance frequency mentioned above is set in a bass and a low frequency sound reproduced by the loudspeaker system 1*a* is therefore enhanced. The loudspeaker system 1*a* thus functions as a device which uses the phase inversion mode which enhances a low frequency sound.

The sound pressure developed by the cone-shaped vibration plate of the loudspeaker unit 2 increases the internal pressure of the hollow chamber Ra inside the cabinet 4*a*. Since the absorbent 3 is disposed in the hollow chamber Ra, the gas absorbing function of the absorbent 3 suppresses a pressure change inside the hollow chamber Ra and the hollow chamber Ra has a large capacity in an equivalent sense. In short, the loudspeaker system 1*a* described above operates as if the loudspeaker unit 2 were fitted to the cabinet 4*a* having a big capacity.

The loudspeaker system 1*a* according to this embodiment thus acts as a phase inversion-type cabinet which has a large apparent capacity, and can reproduce a low frequency sound even at a lower frequency than a limitation of low frequency sound reproduction which is determined generally by the size of a cabinet. In addition, realizing the phase inversion mode using the drone cone 8 whose air permeability is low, the loudspeaker system 1*a* prevents moisture contained in the outside air from invading into the cabinet 4*a*. Hence, the absorption of moisture of the outside air by the absorbent 3 such as activated carbon will not impair the function of physical absorption of a gas inside the hollow chamber Ra. Therefore, the absorbent's physical absorption capability will not be degraded and the effect that the acoustic capacity grows on appearance will not be impaired. Further, when the vibration plate 9 and the suspension 10 are made of a resin material and synthetic rubber or the like respectively and coated with wax, a resin material or the like for better water repellency, invasion of moisture contained in the outside air into the hollow chamber Ra is prevented.

Second Embodiment

Figure 2:
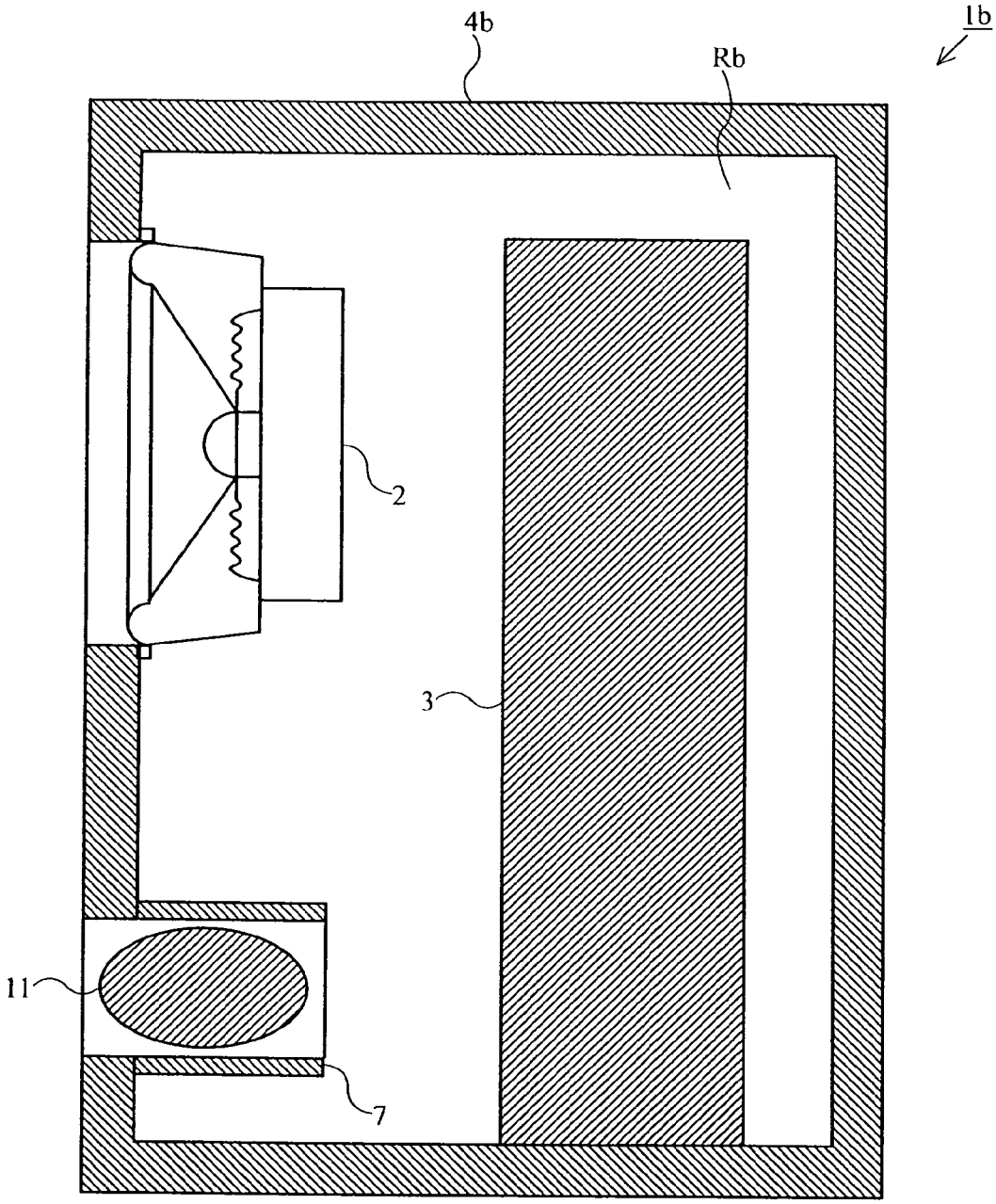
FIG. 2 is a cross sectional view which schematically shows the internal structure of a loudspeaker system 1*b* according to a second embodiment of the present invention.

With reference to FIG. 2, the loudspeaker system according to the second embodiment of the present invention will now be described. The loudspeaker system according to the second embodiment uses a bass reflex-type loudspeaker system as one example of the phase inversion mode. FIG. 2 is a cross sectional view which schematically shows the internal structure of this loudspeaker system 1*b*.

In FIG. 2, the loudspeaker system 1*b* comprises a loudspeaker unit 2, an absorbent 3, a cabinet 4*b*, an acoustic port 7 and a damp proofing agent 11. The cabinet 4*b* forms the front surface, the back surface, the top surface, the bottom surface and the side surfaces of the right-hand side and the left-hand side of a housing of the loudspeaker system 1*b*. The loudspeaker unit 2 is an electrodynamic speaker and fitted to an opening of the front surface of the cabinet 4*b*. Inside the cabinet 4*b*, a hollow chamber Rb of the loudspeaker system 1*b* is created.

The absorbent 3 is disposed inside the hollow chamber Rb. The absorbent 3 is a porous material which physically absorbs a gas and may for example be activated carbon, as in the first embodiment. A porous material is capable of physically absorbing air through fine pores whose sizes are on the order of microns. As other examples, the absorbent 3 may be a carbon nano tube, fullerene, etc. Created above the top of the absorbent 3 is an empty space which ventilates the loudspeaker system 1*b* along the front-rear direction.

The acoustic port 7 is attached to the front surface of the cabinet 4*b* so that the hollow chamber Rb created by the cabinet 4*b* is opened to outside through the acoustic port 7. Utilizing the acoustic capacity of the cabinet 4*b* and acoustic resonance of the acoustic port 7 disposed to the cabinet 4*b*, the loudspeaker system 1*b* radiates a low frequency sound.

The damp proofing agent 11 such as silica gel is disposed inside the inner space of the acoustic port 7. With the damp proofing agent 11 disposed, moisture contained in the outside air which goes into and out of the hollow chamber Rb via the acoustic port 7 is absorbed and invasion of moisture into inside the cabinet 4*b* is prevented. One example is that the damp proofing agent 11 is in the form of granules or powder, and after the damp proofing agent 11 is disposed stationary inside the internal space of the acoustic port 7, the both ends of the acoustic port 7 are closed with a mesh-like cloth which is finer than the grain size of the damp proofing agent 11 or with metal, and their positions are fixed within the acoustic port 7. In other example, the granular or powdery damp proofing agent 11 is sealed up in a perforated bag and disposed inside the acoustic port 7. In either example, it is not necessary to fill up the entire internal space of the acoustic port 7 with the damp proofing agent 11: instead, the amount of the damp proofing agent 11 to dispose inside the acoustic port 7 may be properly adjusted in accordance with the bass enhancement effect of the bass reflex method, the damping effect and the watertight effect of the damp proofing agent 11. The acoustic port 7, owing to the damp proofing agent 11, thus provides water tightness between the external space and the hollow chamber Rb, and such a structure of the acoustic port 7 and the damp proofing agent 11 correspond to the watertight means of the present inventions.

Next, an operation of the loudspeaker system 1*b* will be described. While an operation of the loudspeaker unit 2 which is an electrodynamic speaker is known and will not therefore be described in detail, application of a music signal upon the loudspeaker unit 2 develops force at a voice coil, whereby the cone-shaped vibration plate vibrates and a sound is created. The loudspeaker unit 2 radiates the sound also to the hollow chamber Rb which is inside the cabinet 4*b*. A resonator is thus formed by the internal capacity of the cabinet 4*b* (the capacity of the hollow chamber Rb) and the acoustic mass of the acoustic port 7. At the resonance frequency of the resonator, a sound radiated into inside the cabinet 4*b* is radiated loudly by the acoustic port 7. Since the sound radiated by the acoustic port 7 is in the same phase as that of the sound radiated by the loudspeaker unit 2, this resonance frequency mentioned above is set in a bass and a low frequency sound reproduced by the loudspeaker system 1*b* is therefore enhanced. The loudspeaker system 1*b* thus functions as a device which uses the phase inversion mode which enhances a low frequency sound.

The sound pressure developed by the cone-shaped vibration plate of the loudspeaker unit 2 increases the internal pressure of the hollow chamber Rb inside the cabinet 4*b*. Since the absorbent 3 is disposed in the hollow chamber Rb, the gas absorbing function of the absorbent 3 suppresses a pressure change inside the hollow chamber Rb and the hollow chamber Rb has a large capacity in an equivalent sense. In short, the loudspeaker system 1*b* described above operates as if the loudspeaker unit 2 were fitted to the cabinet 4*b* having a big capacity.

The loudspeaker system 1*b* according to this embodiment thus acts as a phase inversion-type cabinet which has a large apparent capacity, and can reproduce a low frequency sound even at a lower frequency than a limitation of low frequency sound reproduction which is determined generally by the size of a cabinet. In addition, implementing the phase inversion mode using the damp proofing agent 11 inside the acoustic port 7, the loudspeaker system 1*b* prevents moisture contained in the outside air from invading into the cabinet 4*b*. Hence, absorption of moisture of the outside air by the absorbent 3 such as activated carbon will not impair the function of physical absorption of a gas inside the hollow chamber Rb. Therefore, the absorbent's physical absorption capability will not be degraded and the effect that the acoustic capacity grows on appearance will not be impaired. Further, sealed up in a perforated bag or a mesh-like cloth and disposed stationary inside the acoustic port 7, the granular or powdery damp proofing agent 11 functions as an acoustic resistance in the acoustic port 7. As the damp proofing agent 11 damps a low frequency sound radiated from the acoustic port 7, the loudspeaker system 1*b* exhibits a more flat bass characteristic.

As the watertight means which prevents invasion of moisture into inside the hollow chamber Rb through the acoustic port 7, a material which is water-repellent and transmits a gas may be adhered to the both ends of the acoustic port 7. This material ensures ventilation between outside air and the hollow chamber Rb while preventing invasion of moisture contained in the outside air into the hollow chamber Rb. This permits obtaining a similar effect to that promised by the damp proofing agent 11 described above. Instead of covering with such a mesh-like member mentioned above, a material which is water-repellent and transmits a gas may be affixed and additionally the damp proofing agent 11 may be disposed stationary inside the acoustic port 7, thereby further improving the watertight capability which prevents invasion of moisture into inside the hollow chamber Rb.

Figure 3:
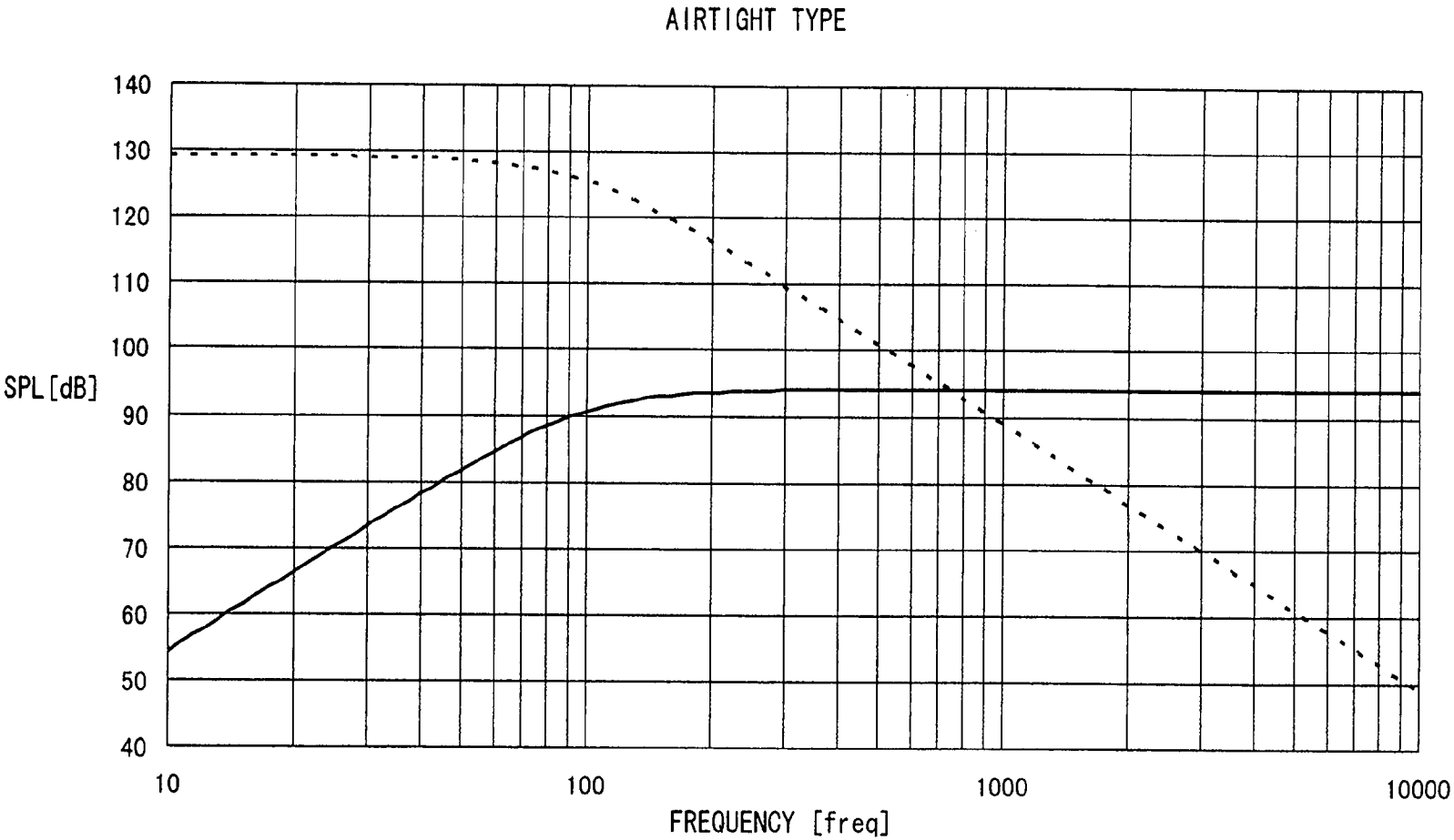
FIG. 3 is a graph of a sound pressure-frequency response in an airtight loudspeaker system and a sound pressure characteristic inside a cabinet.
Figure 4:
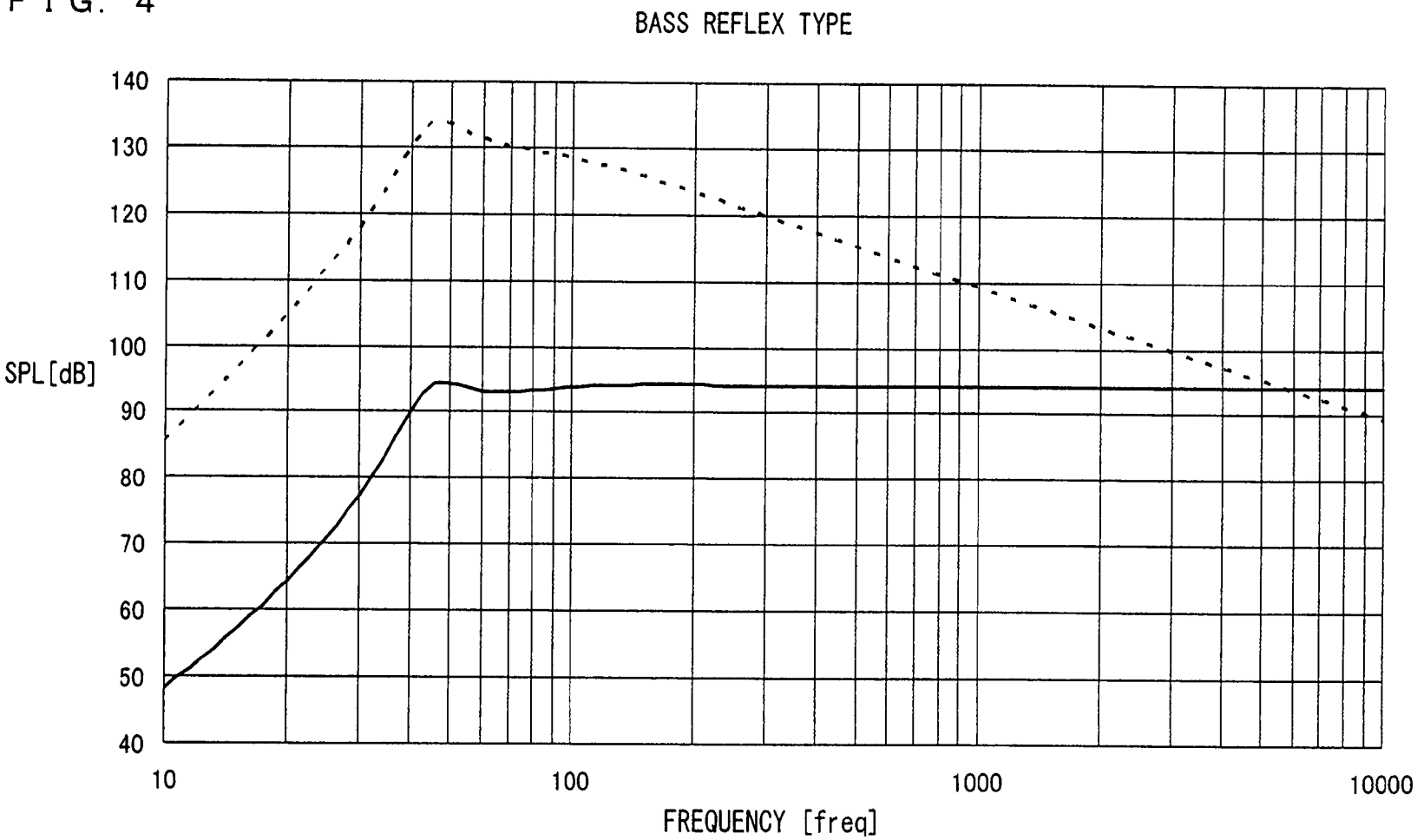
FIG. 4 is a graph of a sound pressure-frequency response in a bass reflex-type loudspeaker system and a sound pressure characteristic inside a cabinet.
Figure 5:
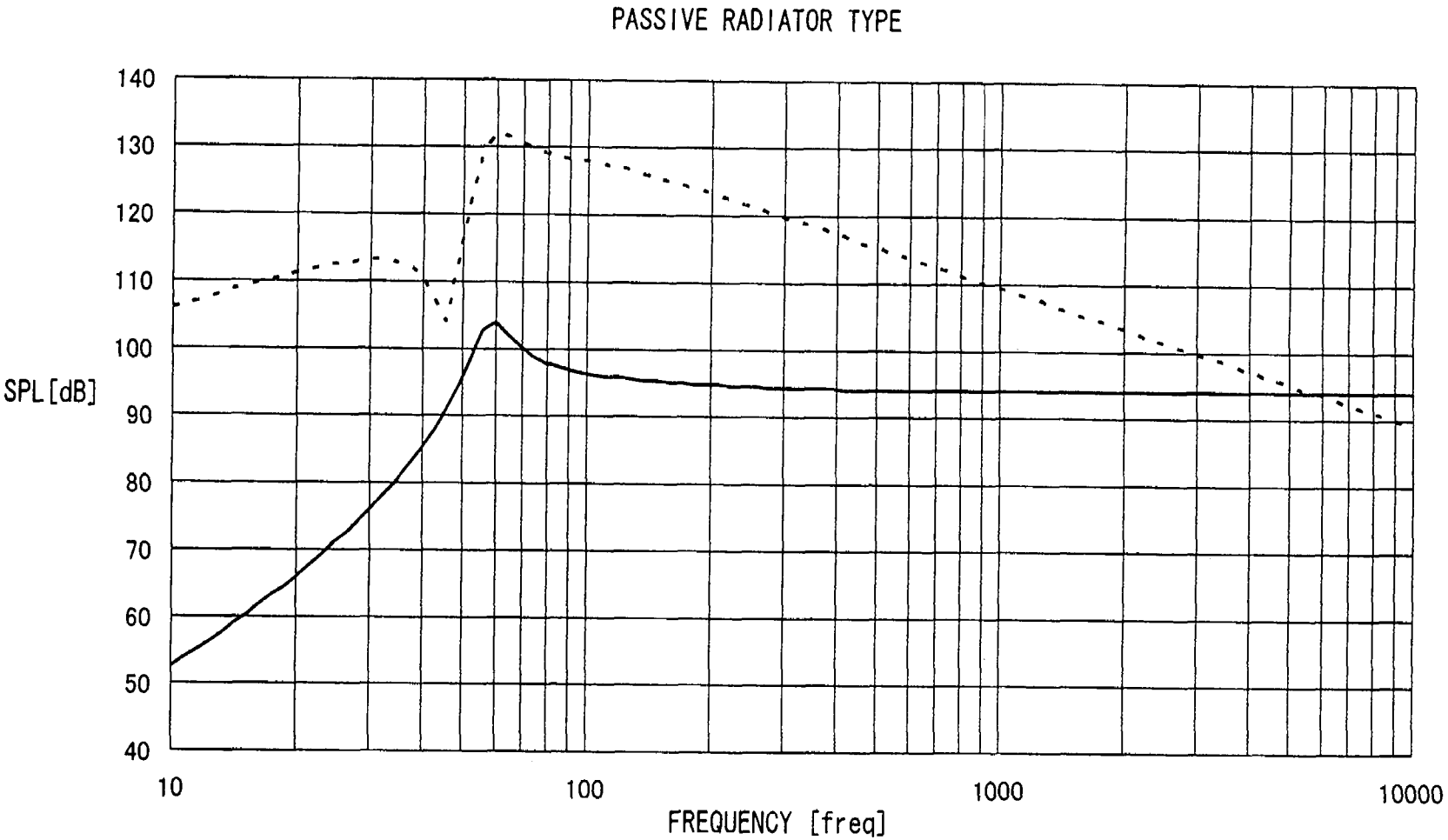
FIG. 5 is a graph of a sound pressure-frequency response in a loudspeaker system of the passive radiator type and a sound pressure characteristic inside a cabinet.
Figure 6:
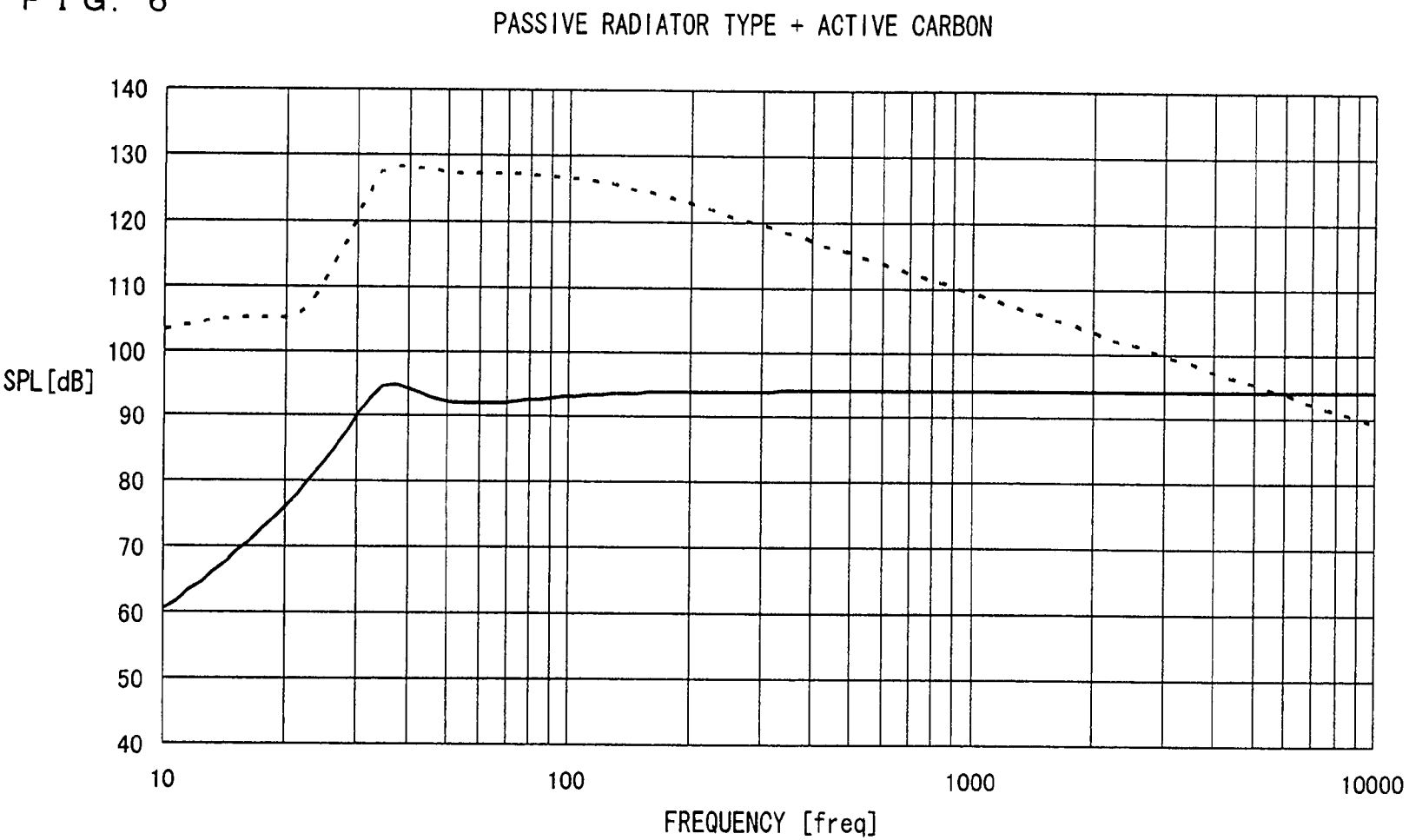
FIG. 6 is a graph of a sound pressure-frequency response in a passive radiator-type loudspeaker system whose cabinet houses activated carbon inside and a sound pressure characteristic inside the cabinet.

The bass enhancement effects brought about by the loudspeaker systems 1*a* and 1*b* according to the first and the second embodiments described above will now be described with reference to FIGS. 3 through 6. FIG. 3 is a graph of a sound pressure-frequency response and an intra-cabinet sound pressure characteristic of an airtight loudspeaker system. FIG. 4 is a graph of a sound pressure-frequency response and an intra-cabinet sound pressure characteristic of a bass reflex-type loudspeaker system. FIG. 5 is a graph of a sound pressure-frequency response and an intra-cabinet sound pressure characteristic of a loudspeaker system of the passive radiator type loudspeaker system. FIG. 6 is a graph of a sound pressure-frequency response and an intra-cabinet sound pressure characteristic of a passive radiator-type loudspeaker system whose cabinet houses activated carbon inside. In each one of the graphs in FIGS. 3 through 6, the frequency (Hz) is measured along the horizontal axis and a sound pressure level (dB) is measured along the vertical axis, and the sound pressure-frequency response is denoted at the solid line and the intra-cabinet sound pressure characteristic is denoted at the broken line. The internal capacities of the loudspeaker systems which exhibit the characteristics shown in FIGS. 3 through 5 are all the same.

As described above, according to the present invention, in an attempt to secure both the absorbent's physical absorption function and the phase inversion mode, the loudspeaker system is structured with the passive radiator mode (the first embodiment) and the bass reflex mode which requires disposing the damp proofing agent inside the port (the second embodiment). In the following, these sound pressure-frequency responses and these intra-cabinet sound pressure characteristics will be compared with each other.

The loudspeaker system according to Patent Document 1 described in "BACKGROUND ART" is of the airtight type, and since the sound pressure inside the cabinet is high as shown in FIG. 3, this loudspeaker system is in a state that it is relatively easy for the absorbent disposed inside the cabinet to exhibit its physical absorption effect. However, since resonance realized by the phase inversion mode can not be utilized, it is not possible to improve the bass characteristic beyond the physical absorption effect.

On the contrary, as shown in FIG. 4, since the sound pressure inside the cabinet in a bass reflex-type loudspeaker system is lower than in an airtight device, the bass reflex-type loudspeaker system is in a state that it is hard for the absorbent disposed inside the cabinet to exhibit its physical absorption effect. In other words, although it is possible to improve the bass characteristic beyond the sound pressure-frequency response which is shown in FIG. 4 owing to the absorbent which is disposed inside the cabinet of the bass reflex-type loudspeaker system, due to the low sound pressure inside the cabinet, it is not possible to obtain a sufficient physical absorption effect. Despite this, since the damp proofing agent 11 is disposed inside the acoustic port 7, the loudspeaker system 1*b* described in relation to the second embodiment can suppress a decrease of the sound pressure inside the cabinet. The loudspeaker system 1*b* maintains the physical absorption effect of the absorbent 3 and is expected to bring about the effect of obtaining an excellent bass reproduction capability.

Further, since the sound pressure inside the cabinet is higher in the case of a passive radiator-type loudspeaker system than in the bass reflex type as shown in FIG. 5, the capacity expansion effect owing to the absorbent's physical absorption effect is excellent and an equivalent resonance-induced bass expansion effect to that of the bass reflex type is obtained. In short, the passive radiator type is more advantageous to sufficiently obtain the absorbent's physical absorption effect and expand the bass owing to resonance. In this respect, the loudspeaker system 1*a* described in relation to the first embodiment is expected to realize a better bass expansion effect than an effect which is achieved by a simple combination of the physical absorption effect and the phase inversion mode, and has a better capability of reproducing the bass with which both the resonance-induced effect and the physical absorption effect are attained. For instance, in the event that the absorbent is disposed inside the cabinet and the physical absorption effect which doubles the internal capacity of the cabinet is obtained, the sound pressure-frequency response sufficiently improving the bass as that shown in FIG. 6 is obtained.

Figure 7:
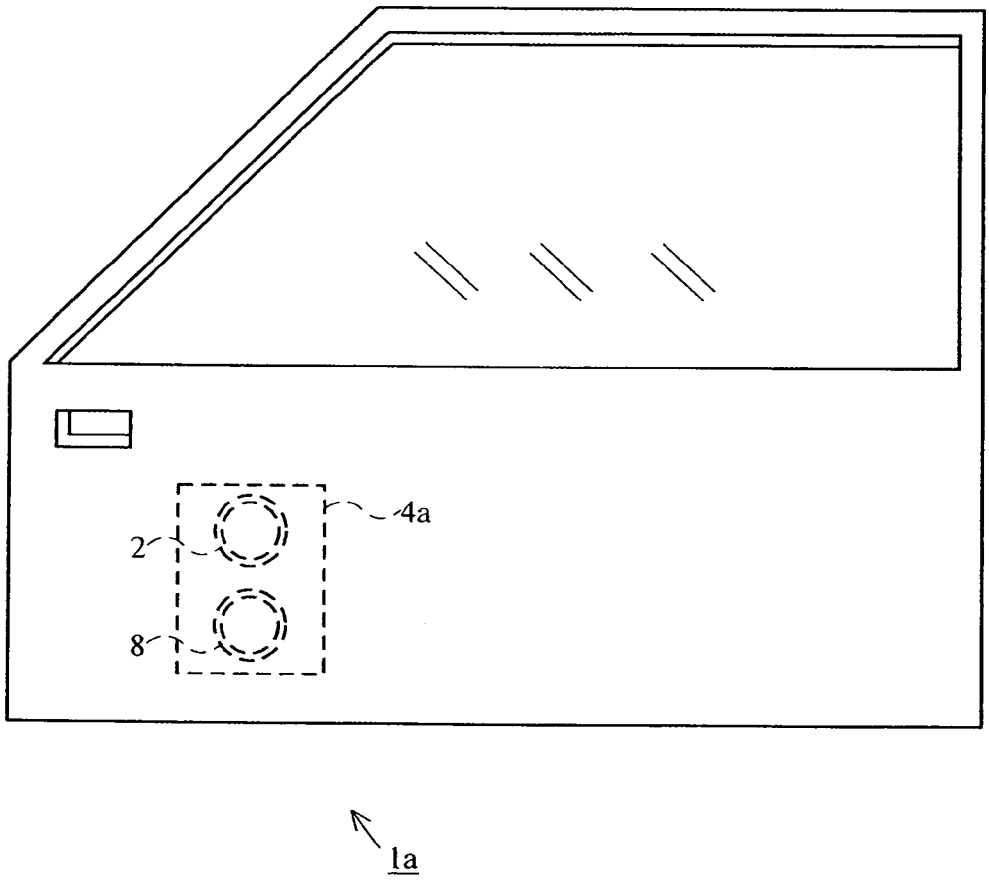
FIG. 7 is a drawing which shows an example of the loudspeaker system 1*a* shown in FIG. 1 for use inside an automobile.

The loudspeaker systems 1*a* and 1*b* described in relation to the first and the second embodiments above are used as automotive loudspeaker systems for instance. FIG. 7 is a drawing which shows an example of the loudspeaker system 1*a* for use inside an automobile.

In FIG. 7, the loudspeaker system 1*a* is fixed inside a door of an automobile. The loudspeaker system 1*a* is denoted at the broken line and as elements forming the loudspeaker system 1*a*, the loudspeaker unit 2, the cabinet 4*a* and the drone cone 8 alone are shown in FIG. 7.

Where a loudspeaker system which is excellent in reproducing a bass is mounted, a cabinet having a large capacity is generally necessary for reproduction of a desired low frequency sound. Meanwhile, a space for installing a loudspeaker system acceptable in the space inside a door of an automobile is very narrow. The loudspeaker system 1*a*, even when its cabinet has a small capacity, is highly capable of reproducing a bass owing to the physical absorption effect of the absorbent 3 and the phase inversion mode. In short, even though the accepted narrow space restricts the capacity of the cabinet 4*a*, the automotive loudspeaker system 1*a* which is capable of richly reproducing a low frequency sound is realized.

Figure 8:
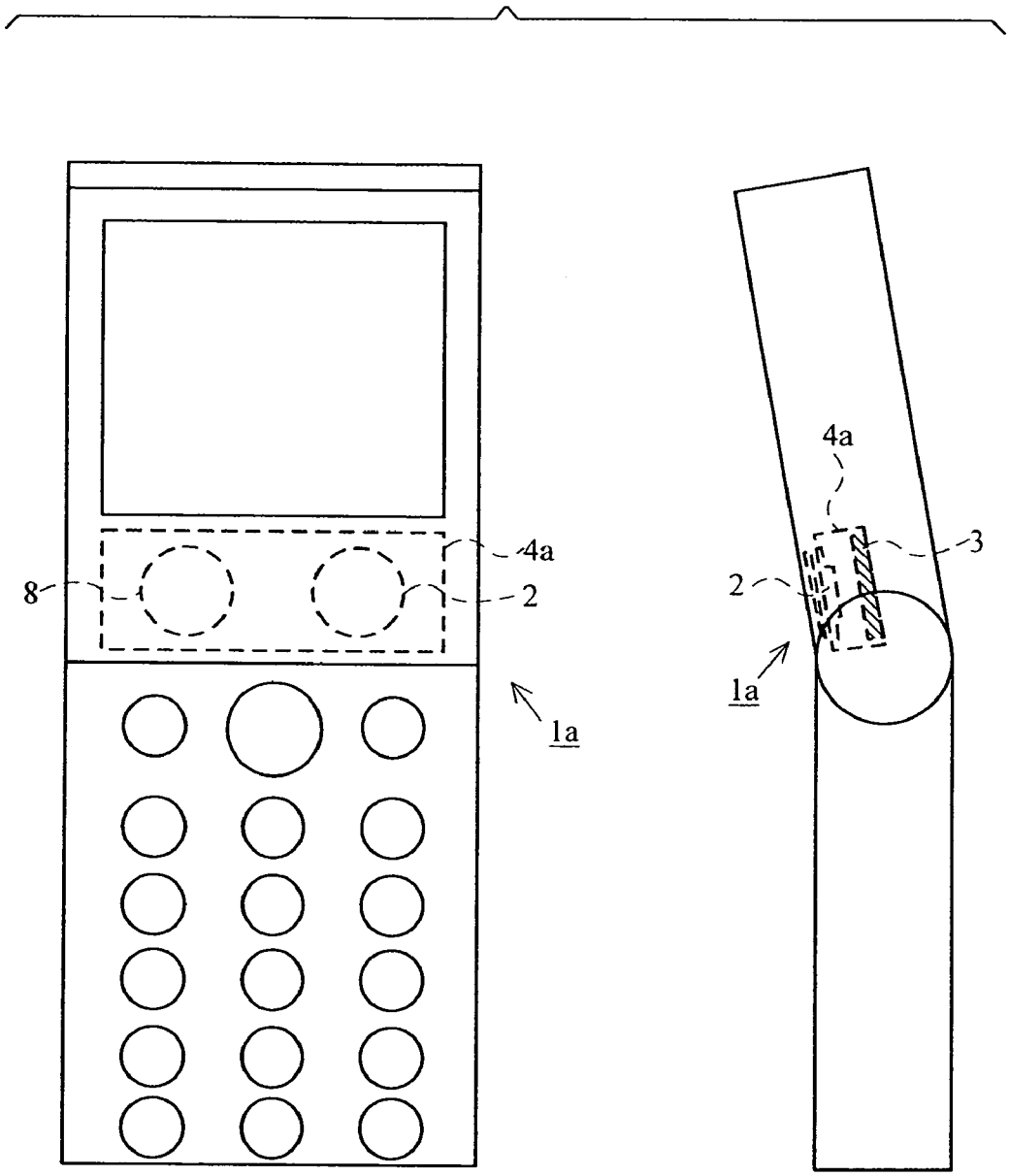
FIG. 8 contains a front view and a side view which show an example of the loudspeaker system 1*a* shown in FIG. 1 for use in a mobile telephone.

In addition, the loudspeaker systems 1*a* and 1*b* according to the first and the second embodiments described above are used as loudspeaker systems for use in portable information processing devices such as mobile telephones for example. FIG. 8 contains a front view and a side view which show an example of the loudspeaker system 1*a* mounted to a mobile telephone.

In FIG. 8, the loudspeaker system 1*a* is fixed inside the housing of a mobile telephone. The loudspeaker system 1*a* is denoted at the broken line and as elements forming the loudspeaker system 1*a*, the loudspeaker unit 2, the absorbent 3, the cabinet 4*a* and the drone cone 8 alone are shown in FIG. 8.

As described above, in the event that a loudspeaker system which is excellent in reproducing a bass is mounted, a cabinet having a large capacity is necessary for reproduction of a desired low frequency sound. Meanwhile, a portable device such as a mobile telephone is constantly faced with a demand for a smaller size, and therefore, and a space for installing a loudspeaker system acceptable in the space inside the housing of a mobile telephone is very narrow. The loudspeaker system 1*a*, even when its cabinet has a small capacity, is highly capable of reproducing a bass owing to the physical absorption effect of the absorbent 3 and the phase inversion mode. In short, even though the accepted narrow space restricts the capacity of the cabinet 4*a*, the loudspeaker system 1*a* for a portable information processing device which is capable of richly reproducing a low frequency sound is realized.

Figure 9:
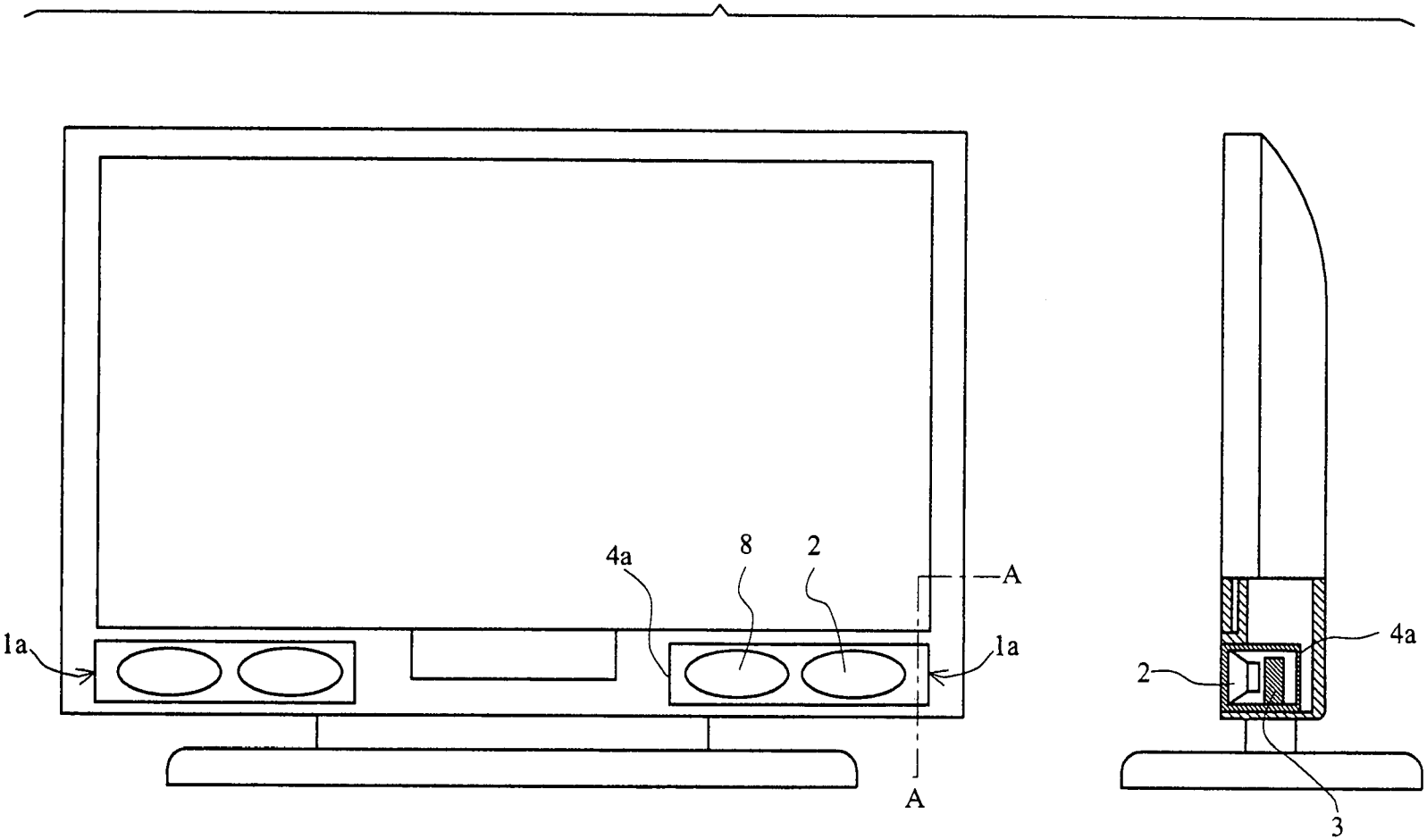
FIG. 9 contains a front view which shows an example of a configuration that the loudspeaker system 1*a* shown in FIG. 1 is mounted in a television set and a side view of a partial internal structure of the television set taken along A-A.
Figure 10:
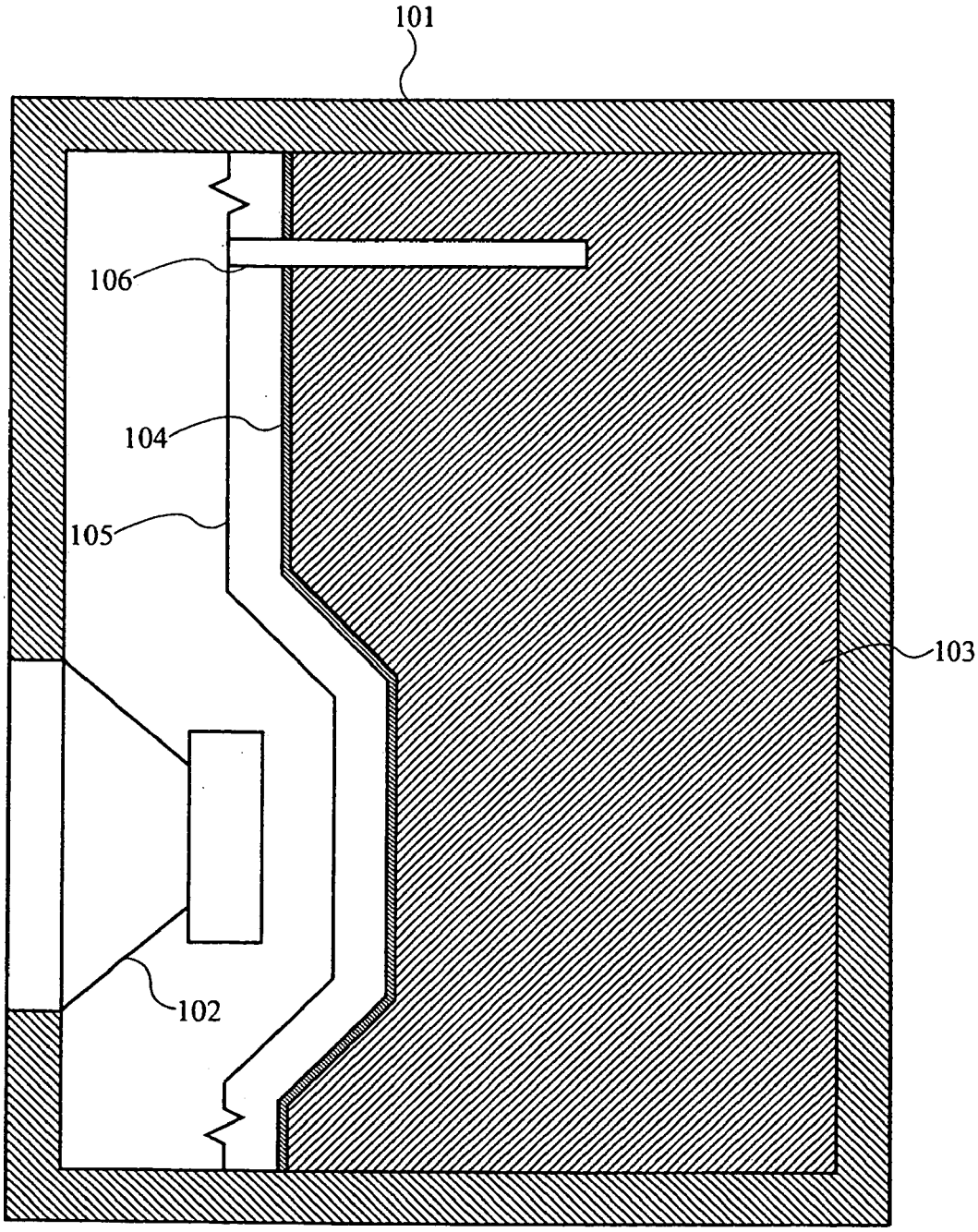
FIG. 10 PRIOR ART
FIG. 10 is a cross sectional view which shows the structure of an essential part of a conventional loudspeaker system.
Figure 11:
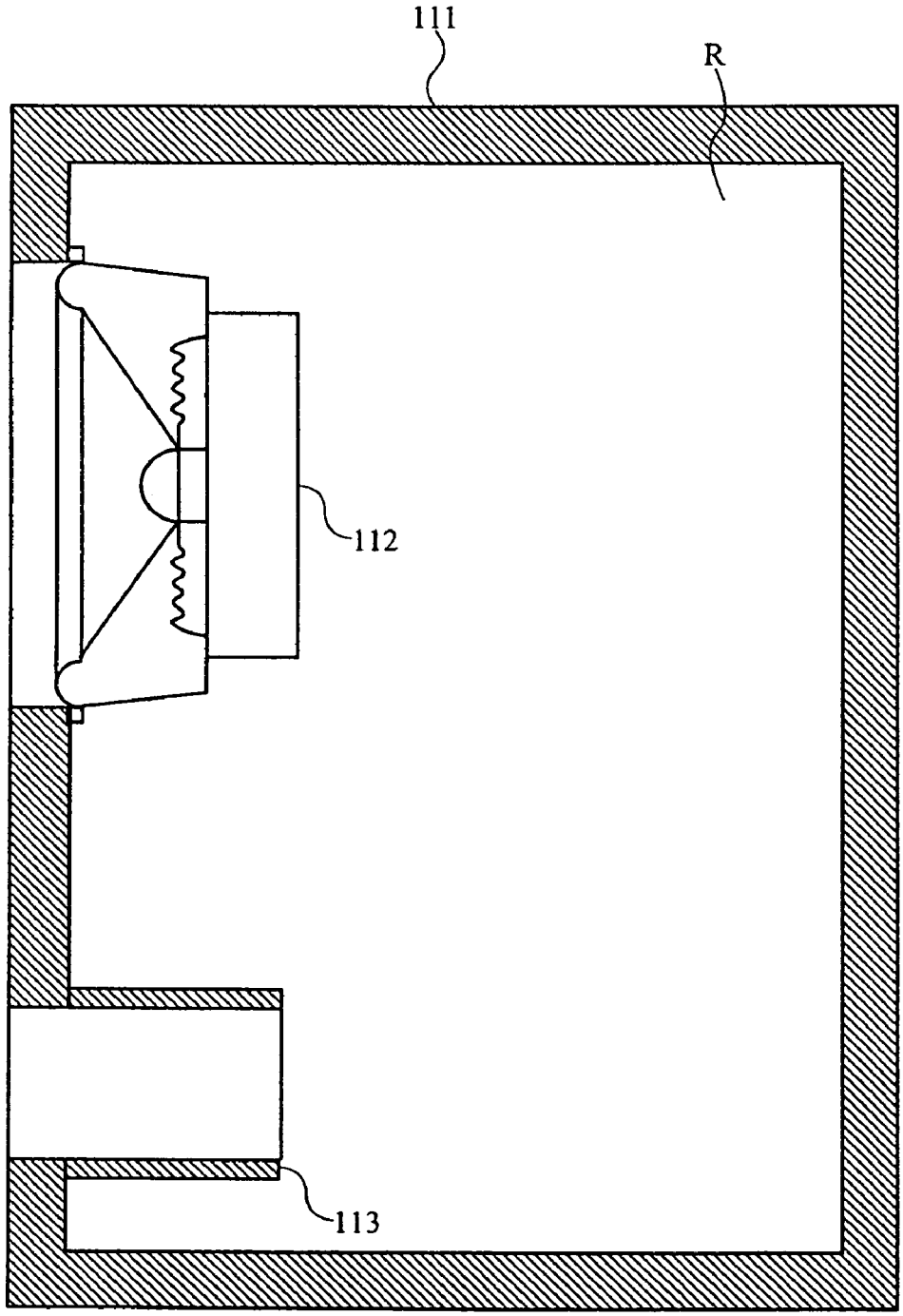
FIG. 11 PRIOR ART
FIG. 11 is a cross sectional view which shows the structure of a conventional bass reflex-type loudspeaker system.

Further, the loudspeaker systems 1*a* and 1*b* according to the first and the second embodiments described above are applicable to a speaker system for use in an audio visual system such as a liquid crystal television set, a PDP (plasma display), a stereo device, a 5.1-channel reproduction home theater which are increasingly thinner. To be more specific, the loudspeaker systems 1*a* and 1*b* are used as speaker systems which are mounted in flat-screen television sets. FIG. 9 contains a front view which shows an example of a configuration that the loudspeaker system 1*a* is mounted in a television set and a side view of a partial internal structure of the television set taken along A-A.

In FIG. 9, the loudspeaker systems 1*a* are fixed inside the housing of a flat-screen television set, one on the right-hand side and the other on the left-hand side. FIG. 9 shows, as elements forming the loudspeaker systems 1*a*, the loudspeaker units 2, the absorbents 3, the cabinets 4*a* and the drone cones 8 alone.

As described above, in the event that a loudspeaker system which is excellent in reproducing a bass is mounted, a cabinet having a large capacity is necessary for reproduction of a desired low frequency sound. Meanwhile, there is a constant demand to make a flat-screen television set thinner, and a space for installing loudspeaker systems acceptable in the space inside the housing of a flat-screen television set is very narrow. The loudspeaker systems 1*a*, even when their cabinets have small capacities, are highly capable of reproducing a bass owing to the physical absorption effect of the absorbents 3 and the phase inversion mode. In short, even though the accepted narrow space restricts the capacities of the cabinets 4*a*, the loudspeaker systems 1*a* for an audio visual system capable of richly reproducing a low frequency sound are realized.

INDUSTRIAL APPLICABILITY

The loudspeaker system according to the present invention is capable of reproducing a bass even with the small capacity of the cabinet, and as such, useful as various types of loudspeaker systems for an automobile, a portable device, an audio visual system, etc.

The invention claimed is:

1. A loudspeaker system, comprising:

a cabinet;

a loudspeaker unit fitted to the cabinet;

an absorbent which is disposed inside a hollow chamber within the cabinet and physically absorbs a gas inside this hollow chamber; and a phase inverting mechanism which inverts the phase by resonating with a sound of a specific frequency radiated from the loudspeaker unit into the hollow chamber and radiates this sound to outside, wherein the phase inverting mechanism includes watertight means for preventing invasion of moisture into inside the hollow chamber from outside the cabinet through the phase inverting mechanism.

2. The loudspeaker system of claim 1, wherein the phase inverting mechanism is a drone cone which is disposed in an opening which is formed in the cabinet, and the watertight means is the drone cone which blocks ventilation between the outside of the cabinet and the hollow chamber.

3. The loudspeaker system of claim 2, wherein the drone cone is coated with at least one of wax and a resin material.

4. The loudspeaker system of claim 1, wherein the phase inverting mechanism is an acoustic port which is disposed in an opening which is formed in the cabinet, and the watertight means is a damp proofing agent which is disposed stationary inside the acoustic port.

5. The loudspeaker system of claim 1, wherein the absorbent is activated carbon.

6. A portable information processing device, comprising:

the loudspeaker system of claim 1; and a housing inside of which the loudspeaker system is fixed.

7. An audio visual system, comprising:

the loudspeaker system of claim 1; and a housing inside of which the loudspeaker system is fixed.

8. A vehicle, comprising:

the loudspeaker system of claim 1; and a vehicle body inside of which the loudspeaker system is fixed.

* * * * *